US005836442A

United States Patent [19]

Hirano

[11] Patent Number: 5,836,442

[45] Date of Patent: Nov. 17, 1998

[54] DOOR SWITCH FOR VEHICLES

[75] Inventor: Mineo Hirano, Tokyo, Japan

[73] Assignee: Niles Parts Co., Ltd., Japan

[21] Appl. No.: 791,740

[22] Filed: Jan. 31, 1997

[30] Foreign Application Priority Data

Feb. 16, 1996 [JP] Japan ..... 8-054098

[51] Int. Cl.[6] ..... H01H 1/00

[52] U.S. Cl. ..... 200/284; 200/531; 200/530

[58] Field of Search ..... 200/284, 520, 200/530, 531, 532, 536, 341, 61.62, 61.76, 61.81

[56] References Cited

FOREIGN PATENT DOCUMENTS 1-130237 9/1989 Japan .
1-172231 12/1989 Japan .

*Primary Examiner*—David J. Walczak

*Attorney, Agent, or Firm*—Ronald P. Kananen; Rader, Fishman & Grauer

[57] ABSTRACT

A door switch for vehicles which is small in depth, capable of being connected by a coupler, and easy to assemble. The door switch has a male connector recessed portion 3 for being fitted with a female connector. The male connector recessed portion 3 is provided at a location adjacent laterally to a cylindrically formed switch slide chamber 2 of a switch case 1. A switch slider 10 having a push rod 12 projecting from the switch slide chamber 2 is slidably mounted in the switch slide chamber 2 with elastic urging by a coiled spring. A switch is provided wherein a movable electrode 22 provided on the switch slider 10 is movable in a direction of sliding so as to be connected to and disconnected from a fixed electrode 21 provided along an inner wall of the switch slide chamber 2. The fixed electrode 21 is an electrically conductive plate having a first end exposed to an inner wall surface of the switch slide chamber 2 and a second end projected into the male connector recessed portion 3.

11 Claims, 7 Drawing Sheets

DOOR SWITCH FOR VEHICLES

BACKGROUND OF THE INVENTION

1. Field of the Invention

The present invention relates generally to a size-reducible switch which is fixed or accommodated around a door of a vehicle and, particularly, to a vehicular door switch that is reduced in size in a depth direction.

2. Description of the Related Art

Various conventional door switches have been employed that perform ON/OFF operations when opening and closing a vehicular door. A conventional vehicular door switch of this kind is shown in FIG. 7, wherein a slidable push rod 52 is elastically urged by a coiled spring 53 in a direction projecting normally from a surface of a base 51 of a case 50, and a movable electrode 56 fixed on the push rod 52 is connected to and disconnected from a fixed electrode 55 disposed on a pole panel 54.

The panel 54 has a bottom face continuous with a connector 57 integrally formed therewith to provide a wiring-connecting coupler 59 which is fitted with a harness side connector 58 after assembling the vehicle. A bracket 60 has a mounting hole that serves also as one of the fixed contacts.

However, in order to improve the accuracy in ON/OFF change-over positions of a door switch, it is desired that the door switch be installed in the vicinity of a striker so that the relative displacement between the door and the switch is reflected significantly. In such cases, there are limitations as to a depth space of an attached portion.

In the above-described conventional door switch structure, it is impossible to install the striker nearby because of an increase in depth (the length L from the attaching surface of the attachment base 51 to the harness-side connector 58). Thus, the striker is generally provided on a hinge side.

To this end, a depth-reduced structure of a harness type door switch can be used (e.g., Japanese Unexamined Utility Model Publication Nos. H1-172231 and H1-130237), which has a coupler independently provided for connection through a harness. The harness-type switch can be reduced in size by installing the coupler at another site, but this involves a problem of increasing costs resulting from an increase in the number of assembly processes, such as the main body-to-coupler connection through the harness.

SUMMARY OF THE INVENTION

An object of the present invention is to provide a door switch that solves the problems associated with the conventional door switches described above.

More specifically, an object of the present invention is to provide a vehicular door switch having a connector and switch assembly that reduce the depth of the switch and are integrated into a single member to reduce the number of components and assembly processes.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In order to achieve the above-described objects and advantages according to the present invention, a door switch is provided that has a connector arranged beside a switch assembly section to reduce the depth of the door switch. Also, an electrically conductive structure of the switch assembly section and an electrically conductive structure of the connector section are integrated by insert-forming a single electrically conductive member, thereby reducing the number of components and the number of assembly processes.

According to a first aspect of the present invention, a door switch for a vehicle comprises a switch slider having a push rod projecting outward therefrom, a switch case having a cylindrical switch slide chamber, the switch slider being slidably inserted into the switch case and elastically urged in a direction projecting outward from the switch case, and a movable electrode provided on the switch slider and fixed electrodes fixed on an inner wall of the switch slide chamber, the movable electrode being movable in a direction of sliding so as to be connected to and disconnected from the fixed electrodes. The door switch is characterized by an integrally formed male connector recessed portion provided at a location adjacent laterally to the switch slide chamber of the switch case for being fitted with a female connector, and by the fixed electrodes having insert-formed ends that project into the male connector recessed portion to form terminals for connecting to a female connector.

The door switch preferably has an insert-formed press-worked metal plate bracket in a flanged portion of the switch case. Part of the metal bracket extends along an inner wall surface of the switch slide chamber of the switch case to provide one of the fixed electrodes.

Each of the terminals preferably comprises an electrically conductive plate having a first end constituting a fixed electrode exposed to an inner wall surface of the switch slide chamber, and a second end in the form of a male connector projected into the male connector recessed portion adjacent to the switch slide chamber.

More specifically, the door switch according to the present invention includes a switch slider 10 having a push rod 12 projected outwardly therefrom. The switch slider 10 is slidably inserted in a cylindrically shaped switch slide chamber 2 formed in a synthetic-resin switch case 1 so that the push rod 12 is urged in a direction projecting outward.

A movable electrode 22 on the switch slider 10 displaces in a sliding direction to be connected to and disconnected from a fixed electrode 21 fixed along an inner wall of the switch slide chamber 2. A male connector recessed portion 3 for being fitted to a female connector 29 is integrally formed at a location laterally adjacent the switch slide chamber 2 of the switch case 1.

For forming the switch case 1 and the male connector recessed portion 3, the fixed electrode 21 fixed along the inner wall of the switch slide chamber 2 is insert-formed so that the other end thereof projects into the male connector recessed portion 3 to thereby constitute a terminal. Since a connector section and a switch assembly section are provided in one body, if an abnormal load is applied to the connector section, there is no possibility of falling out or detachment of the connector section. Moreover, since the connector section is arranged beside the switch assembly section, the switch can be reduced in depth dimension and, hence, the switch can be made more compact.

Also, since the fixed electrode 21 constituting the terminal 20 within the male connector recessed portion 3 is a single component, and the same component is insert-formed during formation of the switch case 1, the fixed electrode 21 can be set with a high degree of accuracy in a position relative to the amount of sliding displacement of a slide electrode of the movable electrode 22, thereby improving the accuracy in a position of ON-OFF change-over.

Also, a press-worked metal plate bracket 5 may be insert-formed into the flanged portion 4 of the switch case 1 so that part of the bracket 5 is arranged along the inner wall of the switch slide chamber 2 of the switch case 1 to provide one of the fixed electrodes as a ground side electrode 8, thereby further reducing the number of assembly processes.

BRIEF DESCRIPTION OF THE DRAWINGS

The present invention will become more clearly appreciated as a description of the invention is made with reference to the accompanying drawings. In the drawings.

DETAILED DESCRIPTION OF THE PREFERRED EMBODIMENT

Figure 1:
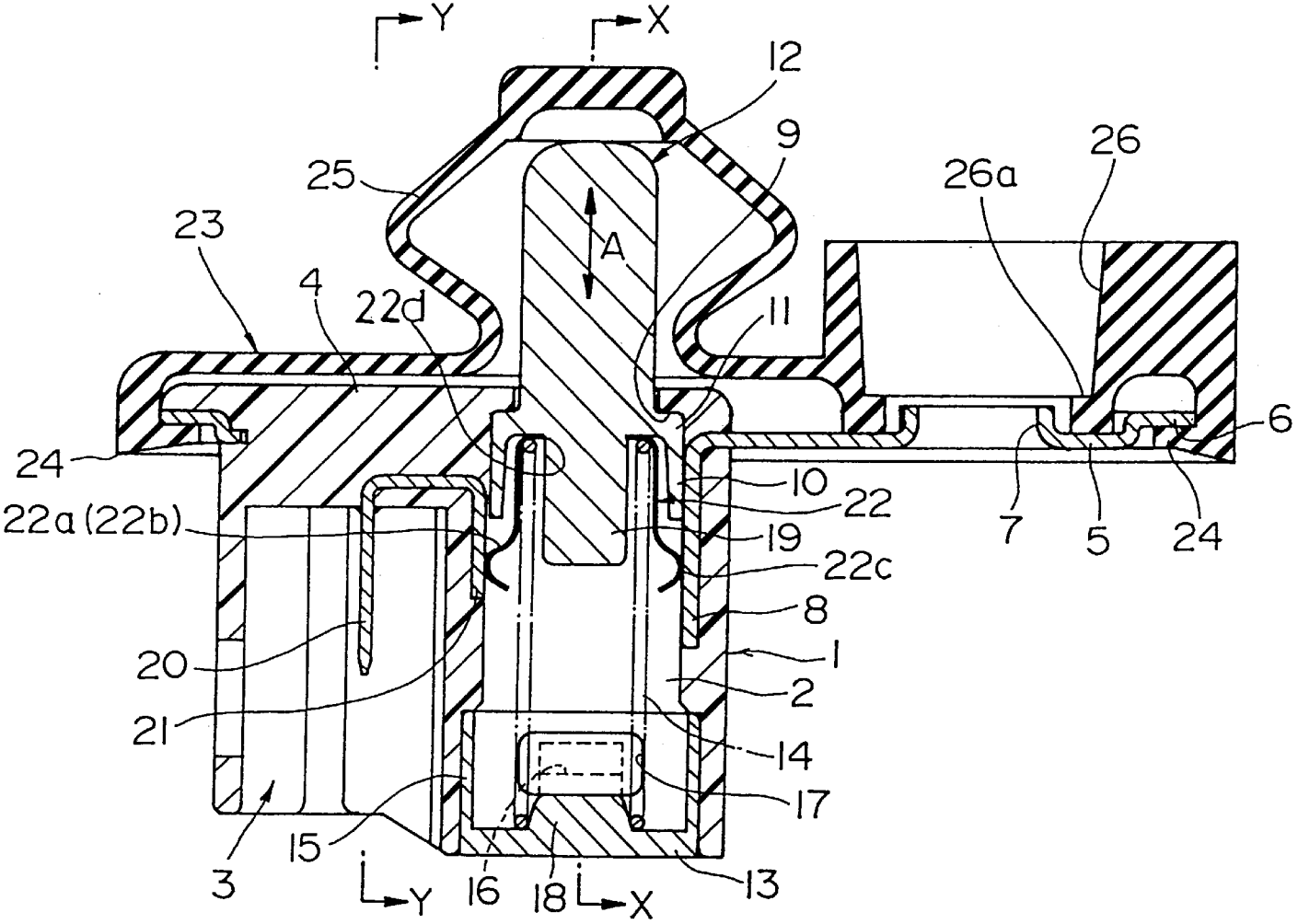
FIG. 1 is a longitudinal sectional view of a door switch for vehicles according to a preferred embodiment of the present invention.
Figure 2:
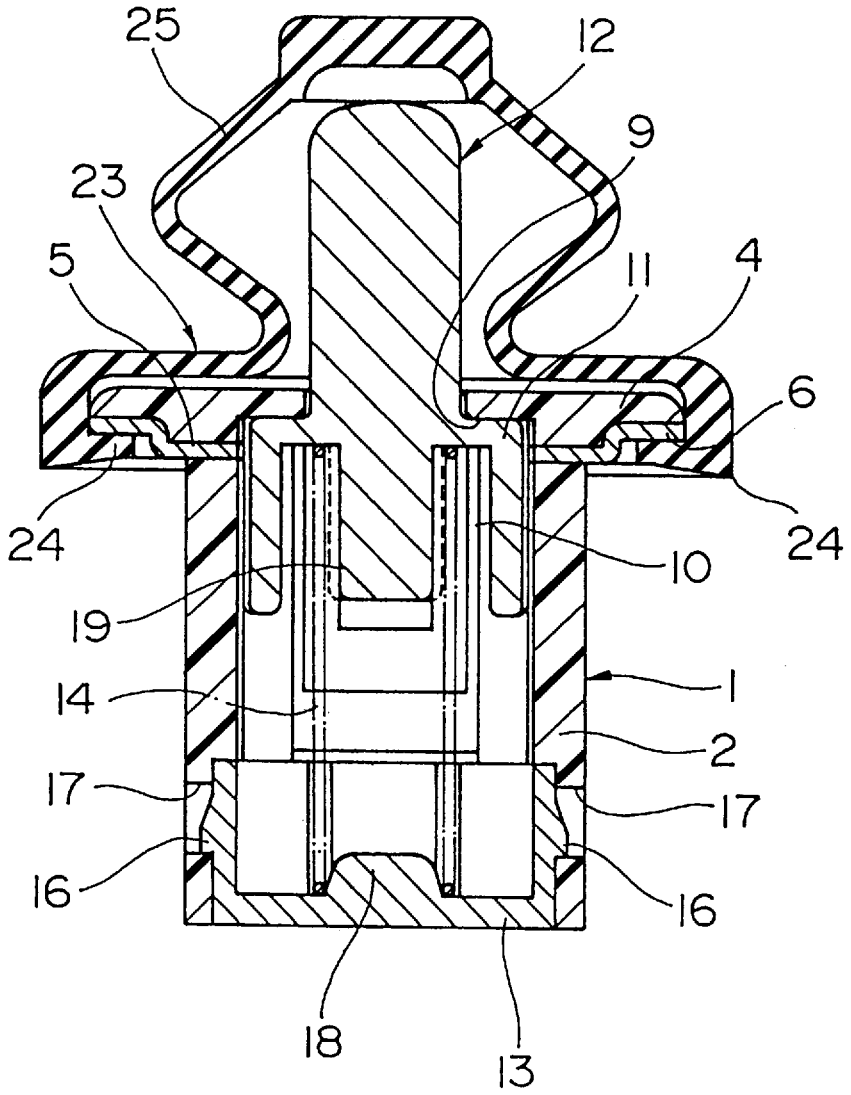
FIG. 2 is a sectional view of the door switch of the present invention taken along line X—X in FIG. 1.
Figure 3:
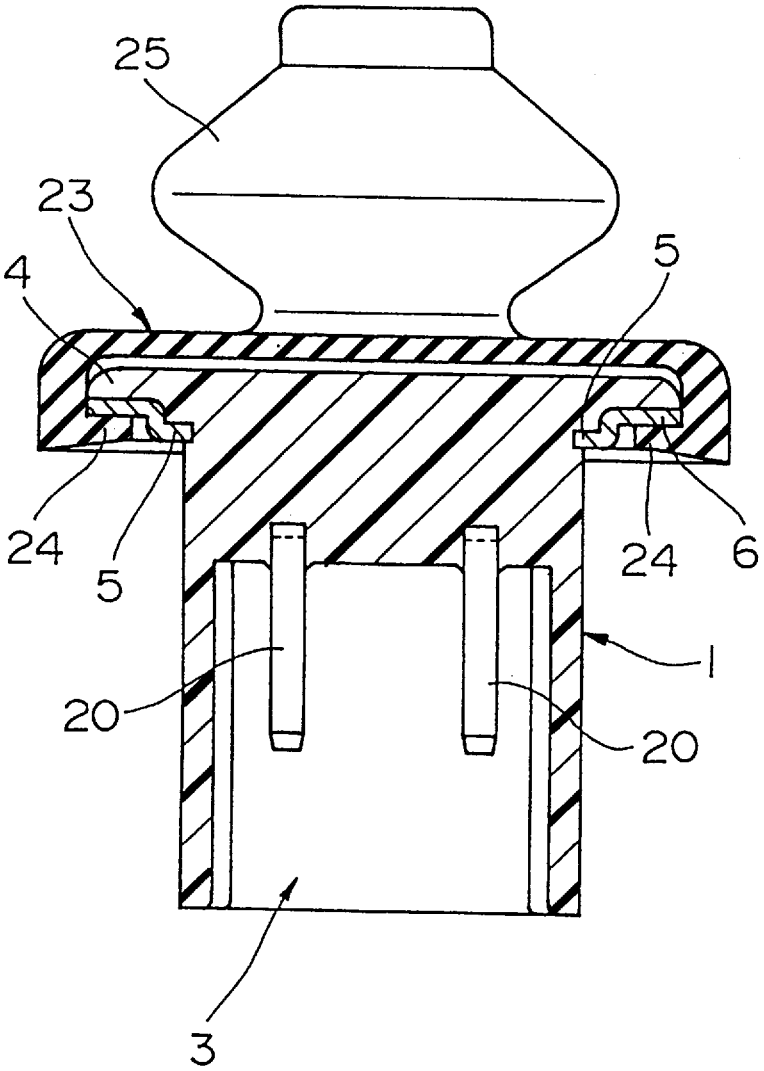
FIG. 3 is a sectional view of the door switch of the present invention taken along line Y—Y in FIG. 1.
Figure 4:
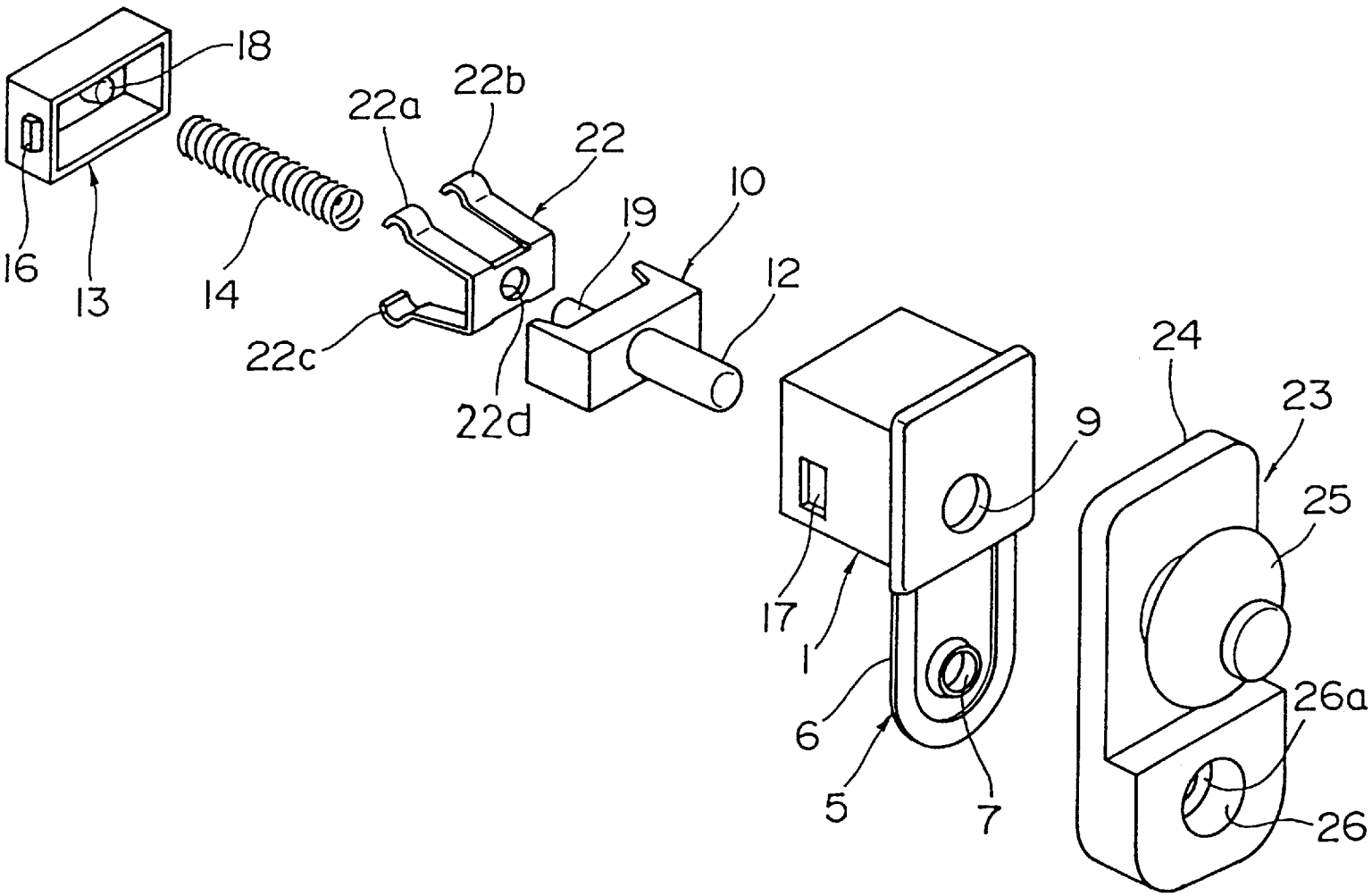
FIG. 4 is an exploded perspective view of the door switch of the present invention.

A preferred embodiment of a vehicular door switch according to the present invention will be described in detail hereinafter with reference to FIGS. 1 to 6 of the accompanying drawings.

The door switch includes a switch case 1 formed of an electrically non-conductive synthetic resin. The switch case 1 is formed from the bottom side to have a switch slide chamber 2 of a rectangular cylinder form and a male connector recessed portion 3 arranged adjacent laterally to the switch slide chamber 2.

In a flanged portion 4 of the switch case 1, a bracket 5 press-worked from an electrically conductive metal plate is insert-formed and integrated simultaneously with formation of the switch case 1 to form a rubber-covered enfold edge 6 in a circumferential edge and a mounting hole 7 with a collar-shaped rise portion opened at one end. The flanged portion 4 also constitutes a ground side electrode plate 8 by exposedly extending part of inner end along an inner wall of the switch slide chamber 2 of the switch case 1.

In the switch slide chamber 2 of the switch case 1, a switch slider 10 having a push rod 12 projecting therefrom is slidably inserted in the direction of arrow A by engaging a shoulder 11 thereof with a step portion 9 formed on the side of the flanged portion 4. The switch slider 10 is elastically urged in an outwardly projecting direction by the coiled spring 14 loaded between the switch slider 10 and the bottom lid member 13 fitted on the bottom side of the slide chamber 2.

The bottom lid member 13 is assembled into one body by snap-engaging a pair of snap engaging projections 16, 16 formed on opposite outer surfaces of the lateral wall 15 thereof with hole edges of aperture windows 17, 17. The coiled spring 14 is loaded in a state that its respective ends are held by an extended portion 18 projected centrally of an inner surface of the bottom lid member 13 and a projecting axis 19 projected centrally of an inner face of the switch slider 10. The coiled spring 14 is prevented against distortion during compression by the projecting axis 19.

A pair of electrically conductive terminals 20, 20 project into an inside of the male connector recessed portion 3 of the switch case 1. The terminals 20, 20 are insert-formed so as to constitute terminal side fixed electrode plates 21, 21 by exposedly extending respectively at the other ends thereof along the inner wall of the switch slide chamber 2 opposite to the ground side electrode plate 8. The terminals 20, 20 are integrated with the switch case 1 simultaneously with the formation thereof.

Between the terminal side electrode plates 21, 21 and the ground side electrode plate 8 is a switch mechanism comprising the movable electrode 22. The movable electrode 22 functions to short circuit or open a conductive path between the fixed electrode plates 8 and 21. The movable electrode 22 is made of a slidable leaf spring formed by an electrically conductive resilient plate member. The coiled spring 14 is attached to the movable electrode 22 by press fitting. An aperture hole **22*d* opened in a base portion of the movable electrode 22 relative to the switch slider 10 is inserted over the projecting axis 19 of the switch slider 10**.

The movable electrode 22 has a structure wherein a plurality of tongue piece sliding ends **22*a*, 22*b*, 22*c* extending from the base portion thereof are placed in slidable press contact at a non-operative position. At an operative position, the tongue piece sliding end 22*c* remains in contact with the ground side electrode plate 8 while the remaining tongue piece sliding ends 22*a*, 22*b* are brought out of contact with the terminal side electrode plates 21, 21 and moved to an inner wall surface of the switch slide chamber 2**.

Figure 5:
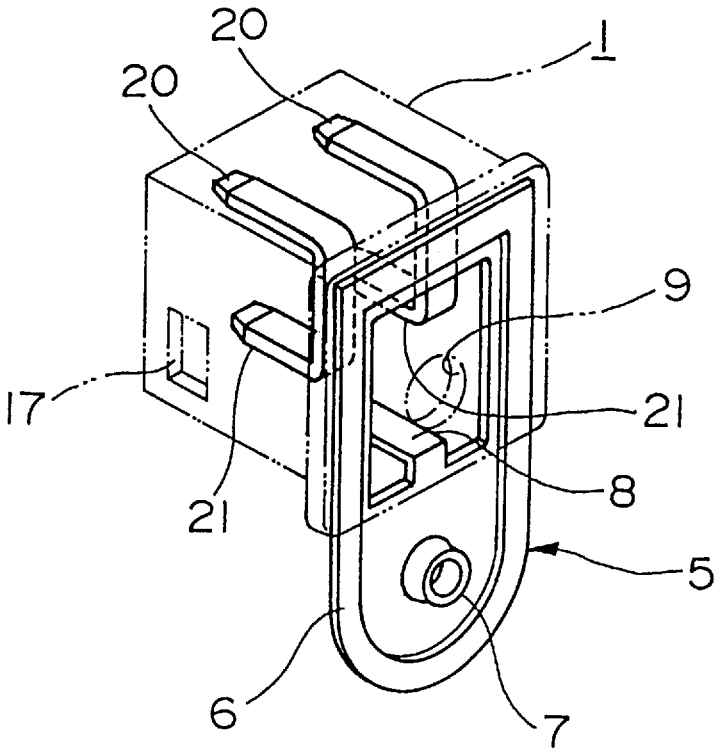
FIG. 5 is a perspective view of a bracket and terminal of the door switch of the present invention.
Figure 6:
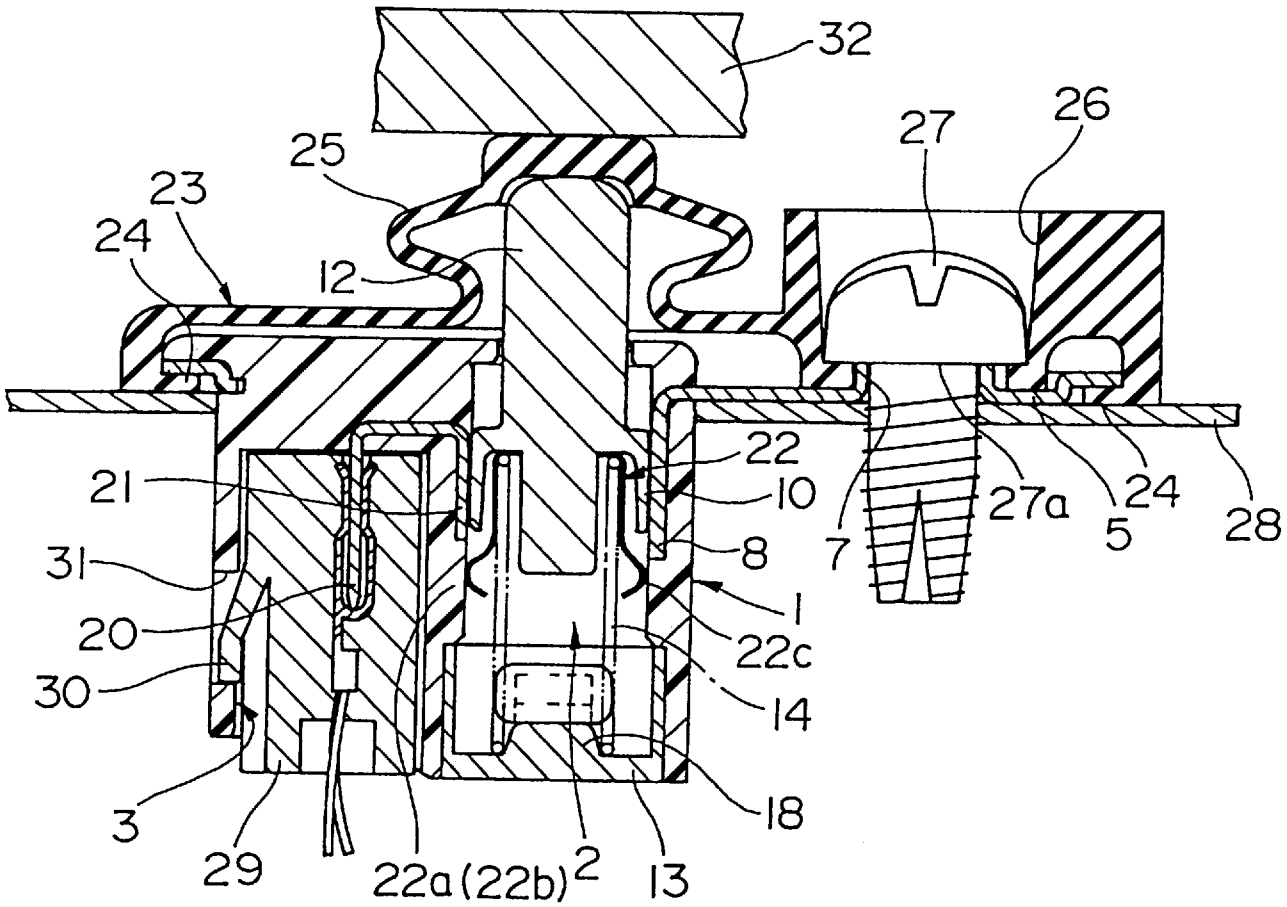
FIG. 6 is a longitudinal sectional view showing an operating state of the door switch of the present invention.
Figure 7:
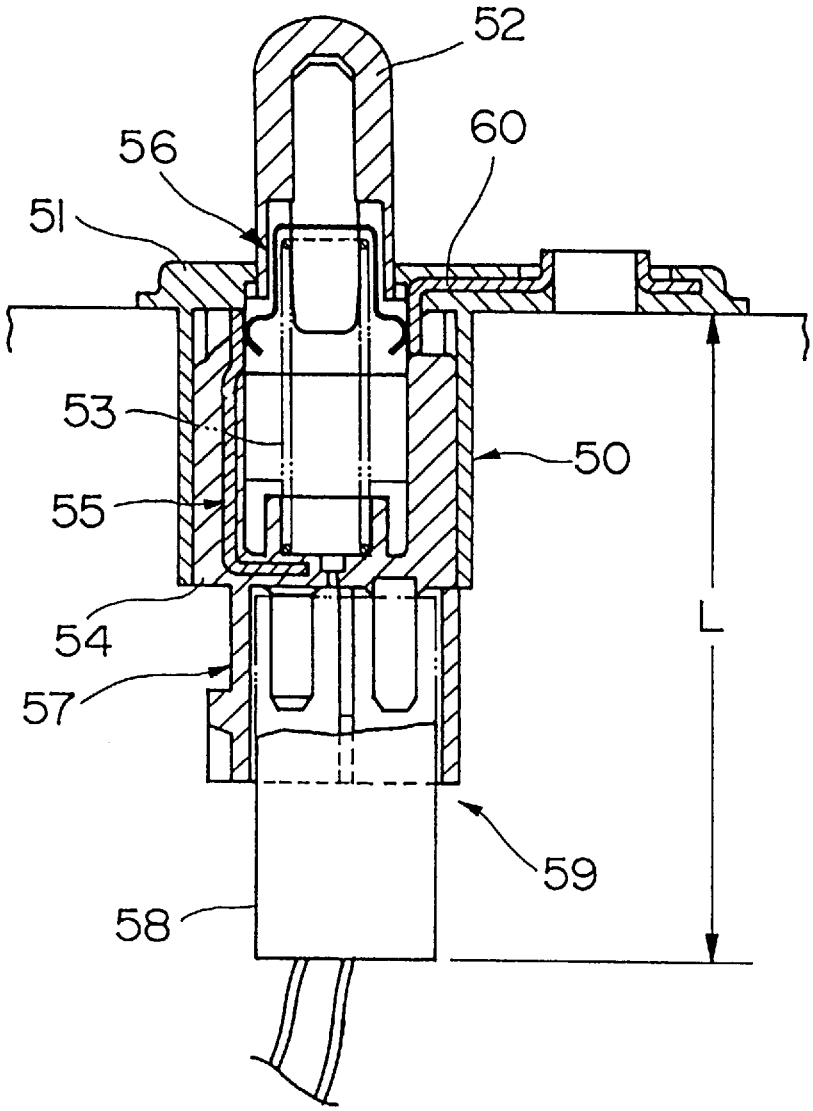
FIG.7 PRIOR ART
FIG. 7 is a longitudinal sectional view of a conventional door switch for a vehicle.

The fixed electrode plates 21, 21 each comprises a generally U-shaped electrically conductive plate, as shown in FIGS. 1, 5, and 6. A first leg of the U-shaped plate is exposed to an inner wall surface of the switch slide chamber 2, a second leg of the U-shaped plate is projected into the male connector recessed portion 3 adjacent to the switch slide chamber 2, and a base portion of the U-shaped plate connecting the first and second legs is embedded within a flanged portion 4 of the switch case 1. The first and second legs of the fixed electrode plates 21, 21 are generally parallel to the sliding direction A, and the base portion connecting the first and second legs is generally perpendicular to the sliding direction A.

As shown in FIGS. 1 and 6, the fixed electrode plates 21 are disposed beside the switch slide chamber 2 and completely within an axial extent over which the switch slider 10 is movable within the switch slide chamber 2. This results in a depth dimension of the door switch being minimized.

A rubber cover 23 provides a water-tight covering over the front face of the switch. The rubber cover 23 has a peripheral end provided with a seal lip 24 for engagement over the rubber covered enfold edge 6. The rubber cover 23 has a diaphragm-formed press-deformable cover portion 25 provided at a position corresponding to the push rod 12 of the switch slider 10, a seal type mounting screw hole 26 at a position corresponding to the mounting hole 7 of the bracket 5, and a seal step portion **26*a* provided higher than the level of the collar of the mounting hole 7**.

As shown in FIG. 6, a mounting screw 27 is provided for fixing the door switch onto a surface of an attachment member plate 28 provided in a door retainer (striker) section.

A neck portion 27*a* of the mounting screw 27 crushes down the seal step portion 26*a* when the mounting screw 27 is tightened and simultaneously causes the bracket 5 to press contact the seal lip 24 on the surface of the attachment plate 28 by depressing the collar in the mounting hole 7. The seal step portion 26*a* and the seal lip 24 of the rubber cover 23 thus provide a water tight structure when the door switch is attached.

The female connector 29 for being fitted with the male connector recessed portion 3 has a connection structure corresponding to the pair of terminals 20, 20 projecting into the connector recessed portion 3. A snap engaging projection 30 configured on a lateral wall of the female connector 29 snap engages with a female connector engaging hole 31 opened in a lateral wall of the male connector recessed portion 3. The snap engaging projection 30 provides a structure for preventing the female connector 29 from falling out of the male connector recessed portion 3.

In the vehicular door switch constructed as above, the switch slider 10 is usually moved in the direction pushing the push rod 12 outward by the elastic force of the coiled spring 14. In this position, the movable contact 22 assembled on the switch slider 10 connects at the tongue piece slide ends 22*a*, 22*b* with the terminal side electrode plates 21, 21 and at the other tongue piece slide end 22*c* with the ground side electrode plate 8. Thus, the switch is placed in an "ON" state by electrically short circuiting between both terminals 20, 20, as well as between the terminal 20 and the bracket 5, which is in electrical conduction with the attachment plate 28 on the vehicle body side.

When the door is closed, the press deformable cover portion 25 of the rubber cover 23 is deformed by the door 32 to press the push rod 12 of the switch slider 10 against the elastic force of the coiled spring 14 so that the movable contact 22 assembled on the switch slider 10 is displaced beyond a predetermined stroke.

Consequently, while the tongue piece sliding end 22*c* of the movable contact 22 remains in contact with the ground side electrode plate 8, the remaining tongue piece sliding ends 22*a*, 22*b* are moved out of contact with the terminal side electrode plates 21*a*, 21*b* and into contact with the inner wall surface of the switch slide chamber 2. Thus, the switch is brought into an "OFF" state by electrically opening the circuit between the terminals 20, 20, as well as between each of the terminals 20 and the bracket 5 (vehicle body).

As stated above, the door switch for vehicles according to the present invention is characterized by a connector section which is integral with a switch case and placed laterally beside the switch case so that the entirety of the switch is reduced in a depth dimension, whereby the door switch can be easily attached to a vehicle body.

Also, according to the above structure, the terminal side electrode plates in sliding contact with the movable electrode and the terminals projecting in the male connector recessed portion are provided in one body and are insert-formed during formation of the switch case. Thus, the number of components and the number of assembly processes can be reduced, thereby providing features such as improvement in productivity, and so forth. The advantages of the present invention are thus very significant.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A door switch for a vehicle, comprising:

a switch slider having a push rod projecting outward therefrom;

a switch case having a cylindrical switch slide chamber, said switch slider being slidably inserted into said switch case and elastically urged in an outward direction from said switch case;

a movable electrode provided on said switch slider and fixed electrodes fixed on an inner wall of said switch slide chamber, said movable electrode being movable in a sliding direction same as that of said switch slider so as to be connected to and disconnected from said fixed electrodes;

an integrally formed male connector recessed portion provided at a location adjacent laterally to the switch slide chamber of said switch case for being fitted with a female connector; and said fixed electrodes, which are fixed on said inner wall of said switch slide chamber, have insert-formed ends that project into said male connector recessed portion to form terminals for connecting to said female connector.

2. The door switch according to claim 1, further comprising an insert-formed press-worked metal plate bracket in a flanged portion of said switch case, wherein part of said bracket extends along an inner wall surface of the switch slide chamber of said switch case to provide one of said fixed electrodes.

3. The door switch according to claim 2, wherein each of, said terminals comprises an electrically conductive plate having a first end constituting a fixed electrode exposed to an inner wall surface of said switch slide chamber, and a second end in the form of a male connector projected into said male connector recessed portion adjacent to said switch slide chamber.

4. A door switch for a vehicle, comprising:

a switch slider having a push rod projecting therefrom;

a switch case having a switch slide chamber, said switch slider being slidably received in said switch slide chamber for movement along a first axis;

a movable electrode mounted on said switch slider movable in a direction same as that of said switch slider for selectively engaging at least one fixed electrode;

an integrally formed male connector recessed portion provided at a location adjacent laterally to said switch slide chamber relative to said first axis; and said at least one fixed electrode comprising a first fixed electrode having a first end exposed on an inner wall surface of said switch slide chamber and a second end projected into said male connector recessed portion adjacent to said switch slide chamber.

5. The door switch according to claim 4, further comprising a metal plate bracket in a flange portion of said switch case, wherein a first part of said metal plate bracket extends along an inner wall surface of the switch slide chamber of said switch case to provide a second fixed electrode.

6. The door switch according to claim 4, wherein said first fixed electrode comprises an electrically conductive plate, and said second end of said first fixed electrode comprises a male connector projected into said male connector recessed portion.

7. A door switch for a vehicle, comprising:

a switch slider having a push rod projecting outward therefrom;

a switch case having a switch slide chamber, said switch slider being slidably receive in said switch slide chamber for movement along a first axis;

a movable electrode mounted on said switch slider movable in a direction same as that of said switch slider for selectively engaging at least one fixed electrode;

and integrally formed male connector recessed portion provided at a location adjacent laterally to said switch slide chamber relative to said first axis, such that said male connector recessed portion is arranged beside said switch slide chamber;

said at least one fixed electrode comprising a first fixed electrode having a first end exposed on an inner wall surface of said switch slide chamber and a second end projected into said male connector recessed portion adjacent to said switch slide chamber; and a metal plate bracket in a flange portion of said switch case, wherein a first part of said metal plate bracket extends along an inner wall surface of the switch slide chamber of said switch case to provide a second fixed electrode and a second part of said metal plate bracket extends away from said first part in a direction generally perpendicular to said first axis, said second part having an opening therein for receiving a mounting screw and an exposed surface for electrically grounding said second fixed electrode to a body of the vehicle.

8. A door switch for a vehicle, comprising:

a switch slider having a push rod projecting outward therefrom;

a switch case having a switch slide chamber, said switch slider being slidably received in said switch slide chamber for movement along a first axis;

a movable electrode mounted on said switch slider movable in a direction same as that of said switch slider for selectively engaging at least one fixed electrode;

an integrally formed male connector recessed portion provided at a location adjacent laterally to said switch slide chamber relative to said first axis;

said at least one fixed electrode comprising a first fixed electrode having a first end exposed on an inner wall surface of said switch slide chamber and a second end projected into said male connector recessed portion adjacent to said switch-slide chamber, wherein said first fixed electrode comprises a generally U-shaped electrically conductive plate, wherein a first leg of said U-shaped plate is exposed on said inner wall surface of said switch slide chamber, a second leg of said U-shaped plate is projected into said male connector recessed portion laterally adjacent to said switch slide chamber, and a base portion of said U-shaped plate connecting said first and second legs is embedded within a flanged portion of said switch case.

9. The door switch according to claim 8, wherein said first and second legs of said U-shaped plate are generally parallel to said first axis, and said base portion connecting said first and second legs is generally perpendicular to said first axis.

10. The door switch according to claim 8, further comprising a second fixed electrode having generally the same structure as said first fixed electrode.

11. A door switch for a vehicle, comprising:

a switch slider having a push rod projecting outward therefrom;

a switch case having a switch slide chamber, said switch slider being slidably received in said switch slide chamber for movement along a first axis;

a movable electrode mounted on said switch slider movable in a direction same as that of said switch slider for selectively engaging at least one fixed electrode;

an integrally formed male connector recessed portion provided at a location adjacent laterally to said switch slide chamber relative to said first axis; and said at least one fixed electrode comprising a first fixed electrode having a first end exposed on an inner wall surface of said switch slide chamber and a second end projected into said male connector recessed portion adjacent to said switch slide chamber such that said first fixed electrode is disposed beside said switch slide chamber and completely within an axial extent over which said switch slider is movable within said switch slide chamber, whereby a depth dimension of said switch is minimized.

* * * * *